United States Patent [19]

Bronicki

[11] 4,104,535

[45] Aug. 1, 1978

[54] HYBRID ELECTRIC POWER GENERATING SYSTEM

[75] Inventor: Yehuda L. Bronicki, Rehovoth, Israel

[73] Assignee: Ormat Turbines (1965) Ltd., Yavne, Israel

[21] Appl. No.: 679,757

[22] Filed: Apr. 23, 1976

[51] Int. Cl.[2] ..... F01K 23/04; H02P 9/04

[52] U.S. Cl. ..... 290/52; 290/40 F; 60/655; 60/667

[58] Field of Search ..... 290/4 R, 4 D, 40 R, 290/40 C, 40 F, 52; 60/655, 660, 664, 665, 667, 676, 706, 711

[56] References Cited

U.S. PATENT DOCUMENTS

| | | | |
|---|---|---|---|
| 3,621,653 | 11/1971 | Pacault | 60/655 |
| 3,795,103 | 3/1974 | Anderson | 60/655 |
| 3,886,748 | 6/1975 | Bronicki | 60/660 |

*Primary Examiner*—Robert K. Schaefer
*Assistant Examiner*—William L. Feeney
*Attorney, Agent, or Firm*—Donald M. Sandler

[57] ABSTRACT

A hybrid power system comprising a pair of energy converters operating on a closed Rankine cycle, each energy converter having a vapor generator for vaporizing a high molecular weight working fluid in response to heat furnished from a burner associated with the generator, a turbo-generator responsive to vaporized working fluid for generating electrical power, a condenser responsive to the exhaust vapors from the turbo-generator for converting such vapors into a condensed liquid, and means for returning the condensed liquid to the vapor generator; sensors for sensing the electrical output of the turbo-generator of each converter; and a control system responsive to the sensors for controlling the burners in the converters so that each converter furnishes about half the electrical load on the system in normal operation thereof; one of the converters, termed the primary converter, operating with a working fluid having a higher boiling point than the working fluid in the other converter which is termed the secondary converter, and means for causing the condenser of the primary converter to reject heat into the vapor generator of the secondary converter when both turbo-generators are operating normally.

14 Claims, 2 Drawing Figures

HYBRID ELECTRIC POWER GENERATING SYSTEM

Figure 1:
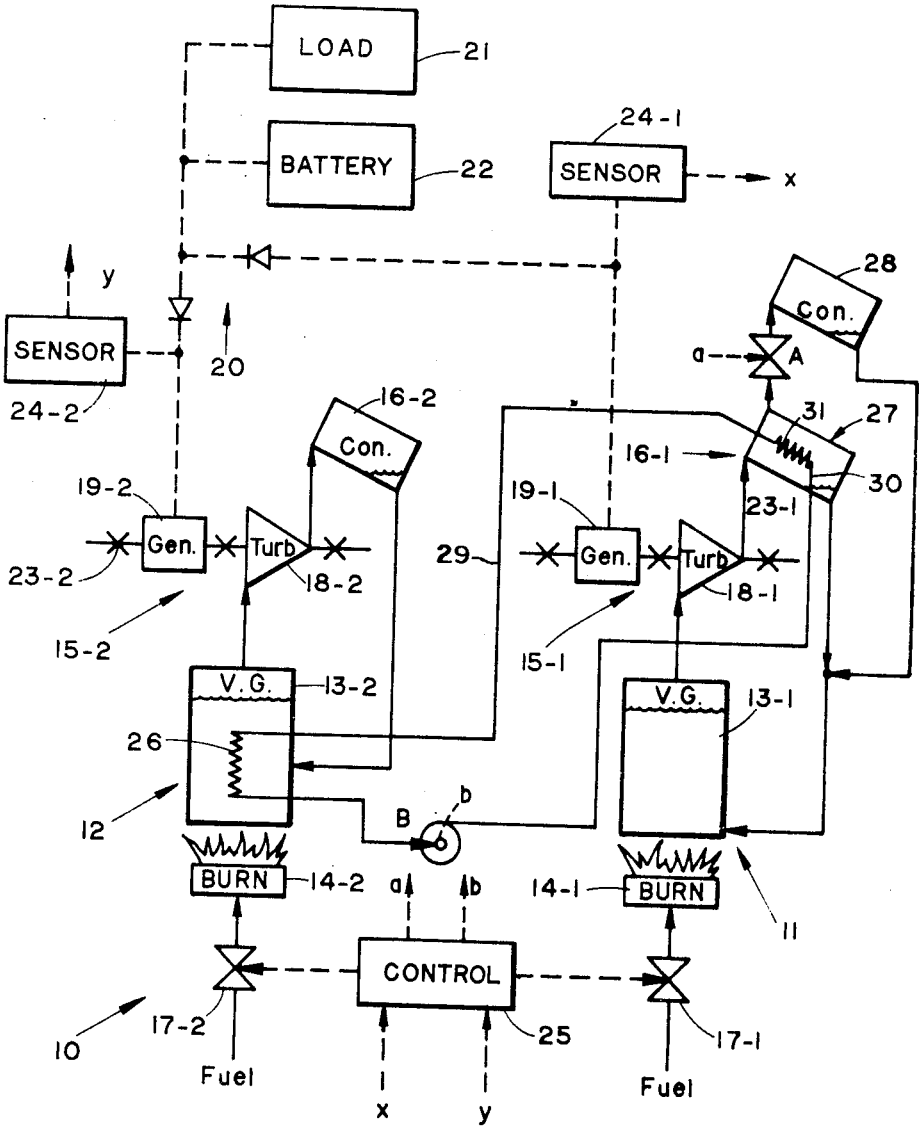

This invention relates to power systems utilizing energy converters that employ a high molecular weight organic working fluid operating in a closed Rankine cycle, hereinafter referred to as energy converters of the type described.

Energy converters of the type described typically comprise a vapor generator for vaporizing the working fluid in response to heat furnished by a burner fuelled for example, by LPG (Liquefied Petroleum Gas), a turbo-generator responsive to vaporized working fluid for generating electrical power, a condenser for converting exhaust vapor from the turbo-generator into a condensed liquid at a low pressure, and means for returning the condensed liquid to the higher pressure vapor generator. Such energy converters are described in detail in U.S. Pat. Nos. 3,397,515 and 3,409,782.

By reason of their reliability, energy converters of the type described are in use throughout the world to provide primary or standby power in remote communication stations requiring continuous, 24 hour per day production of electrical power in the range 0.5 KW to 2 KW. Such stations contain unmanned communication equipment located in places so difficult to gain access to that service and refuelling are carried out only after considerably long intervals of time, for example 6 months or more.

The high reliability of energy converters of the type described arises, primarily because only one moving part is involved, namely a shaft carrying a turbine wheel, a brushless A.C. generator rotor, and if necessary a feed-pump for the condensed liquid; and the entire energy converter is hermetically sealed in a container so that the working fluid is entirely confined and recirculates without loss. Furthermore, the bearings for the shaft are a hybrid hydrostatic hydrodynamic type that utilizes the working fluid for lubrication and support. As a consequence, there is no metal-to-metal contact and no appreciable bearing wear occurs permitting operation on a 24 hour per day duty-cycle. Finally, the starting and control of operation are extremely simple. Start-up is achieved simply by turning on the burner, the bearings being supported by the working fluid when rotation of the shaft commences. Since the generator rotor is mounted on the same shaft as the turbine wheel, the output voltage is directly dependent on the rotational speed of the turbine. This, in turn, depends on the quantity of vapor passing through the turbine, which itself depends on the amount of heat furnished by the burner. Thus, the voltage output can be regulated by the amount of heat applied to the vapor generator. Consequently, the only control required is for the burner. So reliable and simple are converters of the type described that experience has demonstrated a mean-time-between-failure (MTBF) of 18,000 hours as compared with a MTBF of 1,000 hours in the case of a diesel powered system for the same low electrical loads.

While energy converters of the type described are significantly more reliable than diesel powered converters, they are less efficient. For example, energy converters of the type described have an overall efficiency of from 5 to 7% (i.e. the amount of electrical energy delivered to the energy in the fuel burned) while a diesel converter system may have an efficiency as high as 20% at the same load. The lower efficiency of converters of the type described arises by reason of the use of a single stage turbine which is inherently inefficient due to the size of the temperature drop across the turbine required to obtain the desired work output. Expansion in two stages would be more efficient but multiple staging introduces windage and other friction losses that fail to compensate for a more efficient use of the temperature drop.

In many installations, the greater fuel consumption required by energy converters of the type described is more than compensated for by the significantly greater reliability as compared to the reliability of diesel generator. To increase the reliability of the latter, it is conventional to employ redundant converters connected electrically in parallel, one generator being in operation and the other generator being on standby. In theory, when a failure occurs in the operating diesel generator, the idle generator is started-up and takes over the entire load. Actually, the startup procedure on a cold diesel is inherently unreliable so that even with a redundant system, reliability is not significantly improved. However, it is conventional, in many types of station installations, to insist upon redundant converters.

In one form of redundant system as applied to energy converters of the type described, one converter works continuously and a cold standby is brought into operation only if the first converter fails. In view of the relatively simple startup technique, the reliability is significantly increased. For example, if each energy converter is 90% reliable, the redundant system will have a reliability of about 99%, but this increased reliability is paid for in terms of double the capital investment for two complete energy converters. An even more suitable arrangement is one in which a "hot" standby is available involving simultaneous operation of both energy converters at half power so that each delivers half the station load. On the failure of one, the other converter takes over the entire load with the station battery carrying the operation until the surviving converter comes up to full power. This hot standby arrangement is possible with energy converters of the type described by reason of the special bearings utilized therein, which bearings minimise wear permitting longterm operation of the converter without maintenance. For obvious reasons, this technique is not applicable to diesel converters. With energy converters of the type described, however, fuel consumption increases by about 20% as compared to normal operation. For reference purposes, the fuel consumption of such a system is about 70% more than the fuel consumption for a diesel system of the same capacity.

In an effort to improve the fuel consumption, and at the same time to reduce the capital expenditure, it has been suggested (7th Intersociety Energy Conversion Engineering Conference, San Diego, California, Sept. 25–29, 1972) to construct a compound system in which two energy converters are operated in series. That is to say, the primary energy converter would operate with a relatively high boiling point working fluid such as diphenyl-diphenyloxide (DDO), and its turbine would exhaust into a heat exchanger that functions as the vapor generator of the secondary energy converter whose working fluid has a lower boiling point such as monochlorobenzine. The compound system reduces the capital investment by about 10% but, more importantly, the fuel consumption is reduced 50%, to a level below that of a diesel converter with the same load. These advantages are achieved at a decrease in reliability since the compound system is not truly redundant (i.e., failure of either converter will shut down the entire power generating system).

The devices according to the present invention provide truly redundant systems utilizing energy converters of the type described operating on a hot-standby principle achieving not only the high reliability associated with such converters operating in this manner, but a significantly reduced fuel consumption.

According to the present invention there is provided a hybrid power system comprising a pair of energy converters operating on a closed Rankine cycle, each energy converter having a vapor generator for vaporizing a high molecular weight working fluid in response to heat furnished from a burner associated with the generator, a turbo-generator responsive to vaporized working fluid for generating electrical power, a condenser responsive to the exhaust vapors from the turbo-generator for converting such vapors into a condensed liquid, and means for returning the condensed liquid to the vapor generator; sensors for sensing the electrical output of the turbo-generator of each converter; and a control system responsive to the sensors for controlling the burners in the converters so that each converter furnishes about half the electrical load on the system in normal operation thereof; one of the converters, termed the primary converter, operating with a working fluid having a higher boiling point than the working fluid in the other converter which is termed the secondary converter, and means for causing the condenser of the primary converter to reject heat into the vapor generator of the secondary converter when both turbogenerators are operating normally.

Under normal operating conditions, heat in the vapor exhausted from the turbine of the primary converter is rejected into the vapor generator of the secondary converter thus providing a considerable amount of heat to the second converter cycle by reason of a difference in the boiling points of the two working fluids used in the converters. When the working fluid of the primary converter is either diphenyl-diphenyloxide (DDO) or trichlorobenzine, and the working fluid in the second converter is monochlorobenzine (MCB), and the burners of the energy converters are regulated so that each turbo-generator furnishes about half of the electrical load of the system, the fuel consumption of the primary converter will be about 50% of the fuel consumption that occurs when the primary converter furnishes 100% of the electrical load. In such case, the fuel consumption of the secondary converter is only about 10% of the fuel consumption of the secondary converter when it furnishes 100% of the electrical load. Taken together, then the total fuel consumption of the power system operating under the conditions described above, is about 60% of the fuel consumption of either of the converters operating individually to furnish 100% of the electrical load. This is comparable to the fuel consumption obtained with the compound system described at the Engineering Conference referred to above. Furthermore, the reliability of the entire system, which is hereinafter referred to as a "hybrid" system, is very much higher and approaches 90%, provided the reliability of each converter by itself is about 90%. In addition, the MTBF of each converter of the pair should be comparable to the 18,000 hours associated with a single converter, making the hybrid system greatly superior in both fuel consumption, reliability, and MTBF as compared to a diesel generator or a redundant diesel generator system while maintaining the reliability of a redundant energy converter for 60% of its fuel consumption. All of these advantages are achieved at a slight increase in capital expenditure by reason of the special heat exchanger and extra pump and controls required.

In one embodiment of the invention, heat in the exhaust vapors of the turbo-generator of the primary converter is transferred to the lower boiling point liquid in the vapor generator of the secondary converter by means of a tertiary heat transfer fluid, such as Freon, operating in a closed system. In a second embodiment of the invention, the exhaust gases of the turbo-generator of the primary converter are passed directly into a first heat exchanger operatively associated with the vapor generator of the secondary converter. The first mentioned embodiment has the advantage of utilizing smaller sized piping to connect the two converters.

Figure 2:
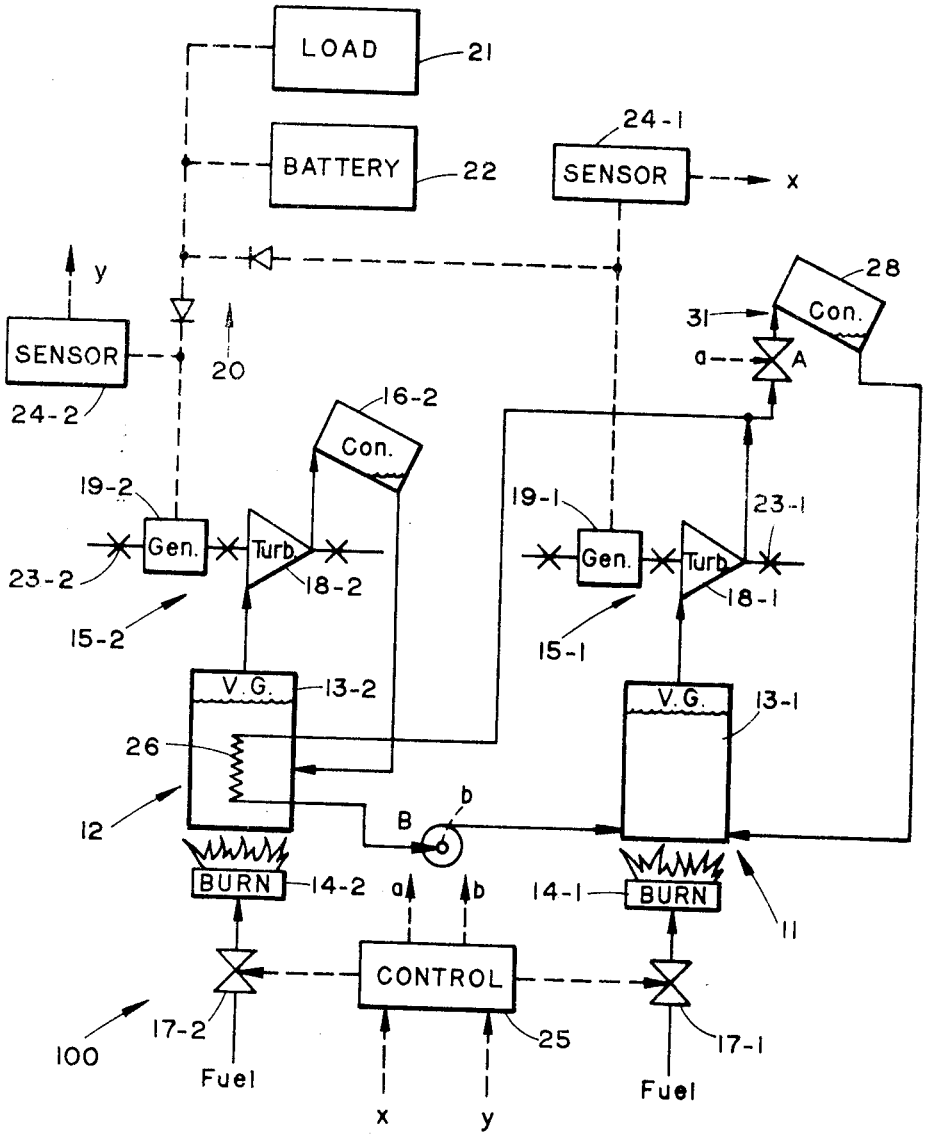

Embodiments of the invention are illustrated by way of example in the accompanying drawings wherein:

FIG. 1 is a block diagram of one embodiment of a hybrid power system according to the present invention wherein a tertiary heat transfer fluid is utilized; and FIG. 2 is a block diagram of a second embodiment of a hybrid power system according to the present invention.

Referrring now to FIG. 1 of the drawing, reference numeral 10 designates the first embodiment of a hybrid power system according to the present invention. Such system includes a pair of energy converters of the type described, converter 11 operating with a higher boiling point organic fluid, preferably diphenyl-diphenyloxide, and termed the primary converter, and converter 12 operating with a lower boiler point organic fluid, preferably monochlorobenzene and termed the secondary converter. Corresponding components in both converters are identified with the same reference numeral followed by -1 or -2 in order to designate association with the primary or secondary converters respectively.

Each converter includes a vapor generator 13, a burner 14, a turbo-generator 15, a condenser 16 and means for returning condensed liquid to a vapor generator. Fuel flowing through a control valve 17 to the burner is burned to vaporize the liquid in the vapor generator. The vaporized working fluid is delivered to the turbine wheel 18 of the turbo-generator where expansion takes place driving the generator rotor 19 attached to the same shaft as the turbine wheel. A homopolar generator is employed, and the resultant A.C. power is rectified at 20 and delivered to an electrical load designated generally by reference numeral 21. Such load is usually a communication system in a remote relay station and a station battery 22 is usually provided in parallel with the energy converter for transient power conditions.

The exhaust vapors from the turbines pass into the respective condensers which reject the heat in the vapors jand condenses them into a liquid at a lower temperature and pressure than the vapor generator. A feed pump (not shown) on the same shaft as the turbo-generator may be used to return the condensed working fluid to the vapor generator. Preferably, the elevation of the condenser is selected such that the hydrostatic head on the condensed liquid is such as to force it into the vapor generator eliminating the need for a pump. While not shown in the drawing, the condensed working fluid passes through the bearings 23 before being returned to the vapor generator.

The electrical output (e.g., the voltage) of each converter is monitored by sensor 24 which produces a control signal *x* or *y* that is applied to a central control 25. Under normal operating conditions, with the control signals indicating rated voltage output of the generators, the control system will establish settings of valves 17 such that sufficient fuel is delivered to each burner to insure that each converter delivers about half the total electrical load. When sensors 24 detect a predetermined drop in the voltage output of one of the generators not arising from a lack of fuel, control 25 responds by closing valve 17 in the converter whose generator voltage has dropped, and opening the valve in the other converter to a setting that will apply enough fuel to the burner of the surviving converter to enable it to take over the entire electrical load. As will be described below, control 25 also furnishes other commands depending upon which converter fails.

The condenser 16-1 of the primary converter includes a first heater changer component 26, a second heat exchanger component 27 and a condenser component 28. Heat exchanger 26 is physically associated with the vapor generator 13-2 of the secondary converter in order to reject heat into the working fluid thereof. Heat exchanger 27 includes two separate flow conduits 29 and 30. The vapor side of conduit 29 is connected to the vapor side of first heat exchanger 26 while the liquid side of conduit 29 is connected to the liquid side of heat exchanger 26 via feed pump B, thus establishing a closed system separate from the working fluid of the primary converter. The closed system contains a tertiary heat transfer fluid, such as Freon, in order to minimize the size of the piping necessary to interconnect heat exchangers 26 and 27.

If the relative elevation of the two converters admits of it, pump B can be eliminated and gravity feed can be used to return the liquid condensed in heat exchanger 26 to heat exchanger 27. In such case, the pump would be replaced by a normally open valve that would be closed by control system 25 in the event of a failure in the secondary converter.

Conduit 30 has its liquid side connected to the liquid side of vapor-generator 13-1 (the condensed working fluid passing first through bearings 23-1) and to the liquid side of auxiliary condenser 28 which is located so as to reject heat ambiently. The vapor side of conduit 30 is connected to the exhaust of turbo-generator 18-1 and is also connected via a normally closed valve A to the vapor side of condenser 28.

In the normal mode of operation of power system 10, each of the converters furnishes half the electrical load. When the working fluid of the primary converter is DDO, and the working fluid of the secondary converter is MCB, control 25 adjusts the valve 17-1 to furnish fuel to the primary converter at a rate about 50% of the rate at which fuel must be furnished were the primary converter to furnish the entire electrical load. At the same time, control 25 adjusts the valve 17-2 to furnish fuel to the secondary converter at a rate of about 10% of the rate at which fuel must be furnished were the secondary converter to furnish the entire electrical load. Thus, in its normal mode of operation, the power system has a fuel consumption that is about 60% of the fuel consumption of either converter operating individually and furnishing the entire electrical load.

The advantage in fuel consumption hybrid system 10 affords can be seen from the following example: Typically, a diesel generator power system for a typical relay station with a 1 KW electrical load, will require about 0.35 gallons of fuel per hour while an energy converter of the type described will require about 0.5 gallons of fuel per hour. With a hybrid system according to the present inventions, the fuel consumption is reduced to about 0.3 gallon per hour which is superior to the fuel consumption of a redundant diesel generator system and considerably more reliable. First of all, the system according to the present invention provides a "hot" standby that will quickly come up to full load when called upon. Second the reliability of the system is greater than the reliability of the individual converters which is itself much greater that in a diesel system.

Should the secondary converter fail, the sensor 24-2 would sense the drop in voltage from generator 19-2, and the *y* control signal applied to control system 25 causes the latter to close valve 17-2 and open valve 17-1 to a setting that will provide vapor generator 13-1 with enough heat to enable the primary converter to deliver the entire electrical load. Simultaneously control signal *a* opens valve A and control signal *b* shuts down pump B. As a consequence, the higher boiling point fluid cycles from vapor generator 13-1, through turbine 18-1 into flow-conduit 30 of second heat exchanger 27 and then into auxiliary condenser 28 which rejects heat into the surroundings and condenses the turbine exhaust vapors for gravity delivery to the liquid side of vapor generator 13-1. Stopping pump B effectively blocks the flow of tertiary fluid into heat exchanger 26 and the resultant waste of heat in the useless vaporization of the lower boiling point working fluid.

The size and capacities of the first and second heat exchangers 26 and 27 are selected to accomplish the desired end of optimizing the fuel consumption of the system in its normal mode of operation. Thus, with organic working fluids other than DDO and MCB, it may be possible to combine the second heat exchanger 27 with the auxiliary condenser 28.

Should the primary converter fail, sensor 24-1 would produce the *x* control signal. In response, the control system 25 would close valve 17-1 and open valve 17-2 to a setting that will provide vapor generator 13-2 with sufficient heat to enable turbo-generator 15-2 to supply the entire electrical load. Simultaneously, control signal *b* would shut down pump B in order to block the flow of tertiary fluid and thus preclude the waste of power and of heat that would occur due to vaporization of the primary working fluid.

Whenever the power system 10 shifts from its normal mode of operation to either of its two emergency modes, battery 22 serves to carry the electrical load until the surviving converter can assume the full load. Since only the response to the application of more heat to the vapor generator is involved, the transient conditions exist for only a short time.

In power system 100 shown in FIG. 2 the second heat exchanger 27 with its flow-conduits 29 and 30 and the tertiary heat exchange fluid are eliminated. Instead, the exhaust vapors of turbo-generator 18-1 are ducted directly into heat exchanger 26 and to normally closed valve A. Finally, the liquid side of heat exchanger 26 is connected via pump B to the liquid side of vapor generator 13-1. If the relative elevation of the two converters admits of it, pump B can be eliminated and gravity feed can be used to return the liquid condensed in heat exchanger 26 to vapor generator 13-1. In such case, the pump would be replaced by a normally open valve that would be closed by control system 25 in the event of a failure in the secondary converter.

Condenser 31 of primary converter 11 thus comprises heat exchanger 26, effective when the system is operating normally (i.e., each converter furnishes half the electrical load) and auxiliary condenser 28 when the secondary converter 12 is out of action. The modes of operation of power system 100, except for the elimination of tertiary heat transfer fluid is the same as the modes of operation of power system 10.

I claim:

1. A hybrid power system comprising a pair of energy converters operating on a closed Rankine cycle, each energy converter having a vapor generator for vaporizing a high molecular weight working fluid in response to heat furnished from a burner associated with the generator, a turbo-generator responsive to vaporized working fluid for generating electrical power, a condenser responsive to the the exhaust vapors from the turbo-generator for converting such vapors into a condensed liquid, and means for returning the condensed liquid to the vapor generator; a sensor associated with each converter and responsive to the output of its turbo-generator for producing a control signal when the output drops below a threshold; and a control system responsive to the sensors for controlling the burners in the converters, the system being responsive to the absence of a control signal for causing the burners to be adjusted such that each converter furnishes about half the electrical load on the system, and being responsive to a control signal from a sensor for causing the burner of the converter with which the sensor is associated to shut down and the other burner to be adjusted such that the other converter furnishes the entire load; one of the converters, termed the primary converter, operating with a working fluid having a higher boiling point than the working fluid in the other converter which is termed the secondary converter, and means for causing the condenser of the primary converter to reject heat into the vapor generator of the secondary converter when both turbo-generators are operating normally.

2. A hybrid power system according to claim 1 including an auxiliary condenser connectable to the condenser of the primary converter when the control system senses a failure in the electrical output of the secondary converter for permitting the primary converter to furnish the entire electrical load.

3. A hybrid power system according to claim 2 wherein the condenser of the primary converter includes a first heat exchanger operatively associated with the vapor generator of the secondary converter, a second heat exchanger having two separate flow-conduits by which heat in the medium contained in one conduit is transferred to the other, one of the flow-conduits being connected to the first heat exchanger so as to form a closed system, and the other of the flow-conduits being connected to the exhaust side of the turbo-generator of the primary converter, and a tertiary heat transfer fluid in the closed system whereby heat in the exhaust vapors of the turbo-generator of the primary converter is rejected into the tertiary fluid which in turn transfers heat into the lower boiling point liquid of the vapor generator in the secondary converter when both turbo-generators are operating normally.

4. A hybrid power system according to claim 3 including a pump for returning tertiary liquid in the first heat exchanger to said one flow-conduit of the secondary heat exchanger.

5. A hybrid power system according to claim 4 wherein the pump is turned off by the control system in response to a failure in the electrical output of the primary converter.

6. A hybrid power system according to claim 3 wherein the liquid side of said other flow-conduit of the second heat exchanger is connected in parallel with the liquid side of the auxiliary condenser and to the liquid side of the vapor generator of the primary converter, the vapor side of said other flow conduit of the second heat exchanger being connected through a normally closed valve to the vapor side of the auxiliary condenser, and means for opening the normally closed valve when the control system senses a failure in the electrical output of the secondary converter.

7. A hybrid power system according to claim 3 wherein the tertiary fluid is Freon.

8. A hybrid power system according to claim 2 wherein the condenser of the primary converter includes a first heat exchanger operatively associated with the vapor generator of the secondary converter for causing heat in the exhaust vapors of the turbo-generator of the primary converter to be rejected into the lower boiling point liquid of the vapor generator of the secondary converter when both turbo-generators are operating normally.

9. A hybrid power system according to claim 8 including a pump for returning liquid in the first heat exchanger to the vapor generator in the primary converter.

10. A hybrid power system according to claim 9 wherein the pump is turned off by the control system in response to a failure in the electrical output of the primary converter.

11. A hybrid power system according to claim 8 wherein the liquid side of the auxiliary condenser is connected to the liquid side of the vapor generator of the primary converter, the vapor side of the auxiliary condenser being connected to the vapor side of the first heat exchanger and to the exhaust side of the turbo-generator of the primary converter through a normally closed value, and means for opening the valve when the control system senses a failure in the electrical output of the secondary converter.

12. A hybrid power system according to claim 1 wherein the higher boiling point fluid is diphenyldiphenyloxide and the lower boiling point fluid is monochlorobenzine.

13. A hybrid power system according to claim 1 wherein the higher boiling point fluid is trichlorobenzene and the lower boiling point fluid is dichlorobenzene.

14. A hybrid power system according to claim 1 wherein under normal conditions, with both converters furnishing about 50% of the electrical load, the primary converter burns fuel at a rate of about 50% of the rate required for this converter to furnish the entire electrical load, while the secondary converter burns fuel at a rate of about 10% of the rate required for the secondary converter to furnish the entire load.

* * * * *